United States Patent [19]

Taylor

[11] 4,126,072

[45] Nov. 21, 1978

[54] STRINGED MUSICAL INSTRUMENT

[76] Inventor: Robert A. Taylor, 3686 Richbriar Ct., Nashville, Tenn. 37211

[21] Appl. No.: 793,285

[22] Filed: May 3, 1977

[51] Int. Cl.[2] ..... G10D 1/00; G10D 1/08

[52] U.S. Cl. ..... 84/173; 84/291; D56/1 A

[58] Field of Search ..... D56/1 A; 84/173, 267, 84/284, 285, 290, 291, DIG. 21, DIG. 17

[56] References Cited

U.S. PATENT DOCUMENTS

| | | | |
|---|---|---|---|
| D. 219,620 | 12/1970 | Moore | D56/1 A |
| 587,089 | 7/1897 | Duck | 84/285 |
| 3,780,612 | 12/1973 | Robinson | 84/173 |
| 3,853,032 | 12/1974 | Freeman | 84/275 |

*Primary Examiner*—Lawrence R. Franklin
*Attorney, Agent, or Firm*—Shlesinger, Arkwright, Garvey & Dinsmore

[57] ABSTRACT

A stringed musical instrument including a body which is formed from an elongated wooden board having front and rear surfaces. The rear face of the body is hollowed out to provide an elongated cavity extending longitudinally through a large portion of the body's length leaving a relatively thin top surface superjacent thereto. A fingerboard is positioned on the top surface of the body above the cavity and extends longitudinally thereof. Multiple strings extend longitudinally of the body above the fingerboard in engagement with bridge means, and means are provided at both ends of the body for holding the strings under tension.

9 Claims, 5 Drawing Figures

STRINGED MUSICAL INSTRUMENT

BACKGROUND OF THE INVENTION

Stringed musical instruments such as guitars have been conventionally made over the years by assembling multiple pieces of wood or the like together to form a hollow body, and then affixing strings, a fingerboard, bridges and keys thereto in a well known manner. The pieces comprising the body are, in the case of many instruments, difficult to make due to their irregular shape and contour. The manufacture of such instruments is, therefore, a time consuming operation involving many steps. As a result, the price of these instruments to the purchaser is necessarily high and beyond the means of many persons who would like to play these instruments.

SUMMARY OF THE INVENTION

The present invention pertains to a stringed musical instrument and to a process for making the same, the instrument requiring a minimum of inexpensive parts which are readily prepared and assembled, thereby substantially lowering the cost to the purchaser as compared to conventional style musical instruments now available.

In accordance with the present invention, the body thereof is preferably constructed from a standard wood board of standard width and thickness, such as 1 inch by 4 inches, 1 inch by 6 inches or 1 inch by 8 inches. After the board is cut to the desired length, one face thereof is hollowed out to form a cavity extending through a large portion of the body's length, leaving a relatively thin top surface of predetermined thickness above the cavity. A fingerboard is positioned longitudinally of the top surface of the body and bridges are placed adjacent the ends thereof for receiving strings which extend above the fingerboard, the strings being secured at one end of the body and attached to pegs which are adjustably secured to the opposite end of the body. A peghead for receiving the pegs may be formed by reducing the width of one end thereof to provide a central extension.

The present musical instrument is played by placing the same on a suitable surface which acts as a sounding board and produces a tone of high quality. The tone and volume of the instrument may be varied by changing the surface on which the instrument rests while playing.

DESCRIPTION OF THE INVENTION

Figure 1:
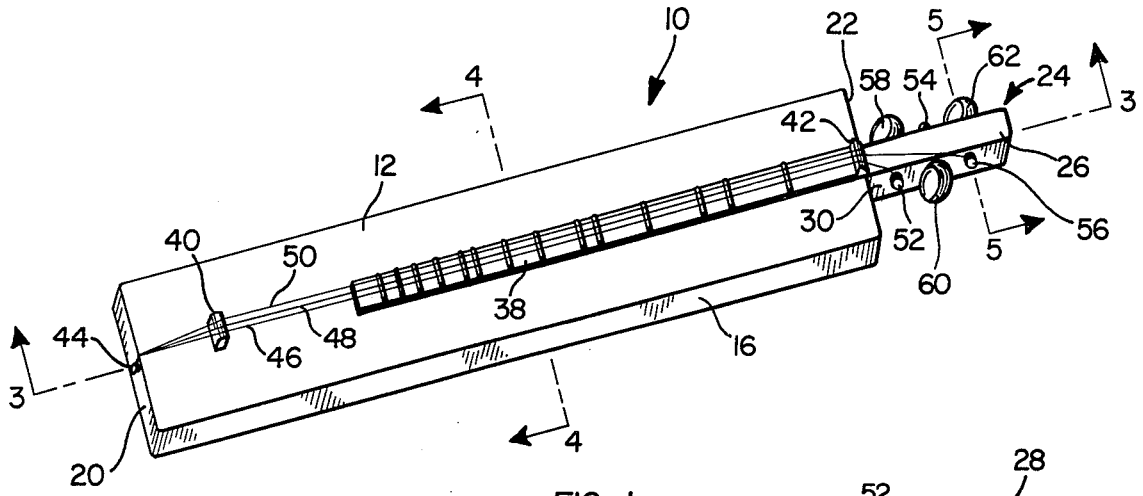
FIG. 1 is a top perspective view of a stringed musical instrument constructed in accordance with the present invention.

The stringed musical instrument of the present invention includes a body generally designated 10 which is preferably constructed from an elongated standard wooden board, such as fir, pine or spruce wood. In the form of the invention illustrated, body 10 is constructed from 1 inch by 4 inch pine board approximately 2 feet in length and including a top surface 12, a bottom surface 14, sides 16 and 18 and ends 20 and 22. One end of body 10 is reduced in width to form a central extension forming a peghead 24 having a top 26, a bottom 28, sides 30 and 32 and an end 34.

Figure 2:
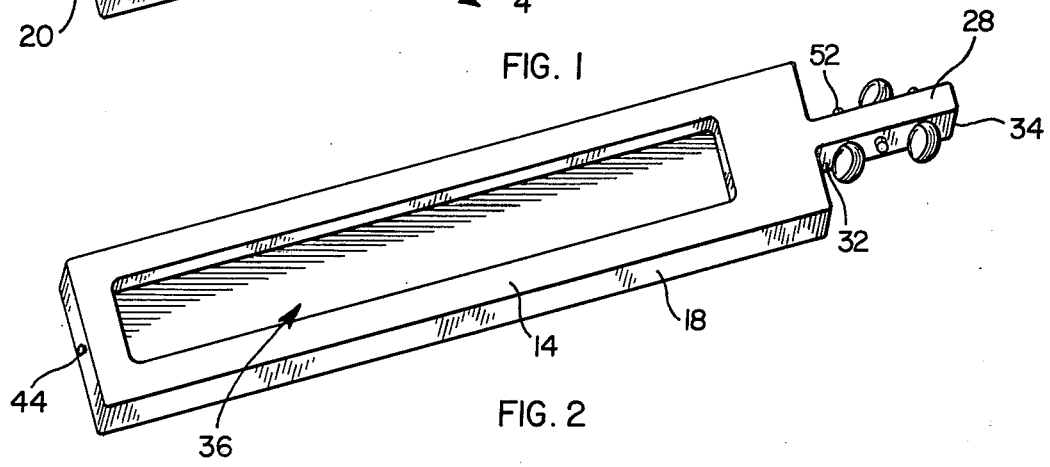
FIG. 2 is a bottom perspective view of the same.
Figure 3:
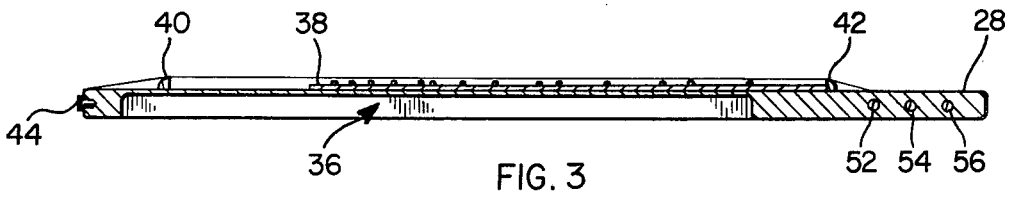
FIG. 3 is a longitudinal sectional view taken along the line 3—3 of FIG. 1, looking in the direction of the arrows.
Figure 4:
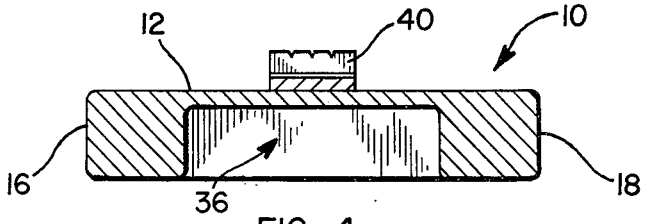
FIG. 4 is an enlarged transverse sectional view taken along the line 4—4 of FIG. 1.
Figure 5:
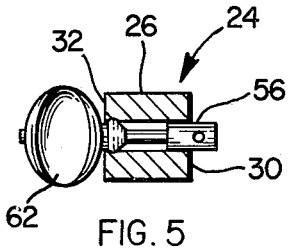
FIG. 5 is an enlarged sectional view taken along the line 5—5 of FIG. 1, looking in the direction of the arrows.

Referring now to FIG. 2, it is a salient feature of the present invention to hollow out a major portion of bottom 14 by milling or any other suitable method to provide an elongated cavity 36 of a pedetermined depth in order to attain the objectives of this invention. It has been found that for optimum results, the bottom surface must be hollowed out in such a manner that there is provided a uniform, thin top surface above the cavity which may range from 1/16 inch to ½ inch, a thickness of 3/32 inch to 5/32 inch having been found to produce the best musical tones. Additionally, in the case of the musical instrument illustrated in the drawing, it has also been found that a cavity volume of between 9⅞ cubic inches and 10⅝ cubic inches effects the best muscial tones. As will be noted from the drawing, the longitudinal axis of said cavity coincides with the longitudinal axis of body 10 and peghead 24.

Referring to FIG. 1, it will be seen that a fretted fingerboard 38 is positioned on top surface 12 of body 10 which fingerboard is of standard plastic construction and extends longitudinally and centrally of the body above cavity 36. A bridge 40 having a plurality of string notches is adhesively secured to top 12 in longitudinally spaced relation to fingerboard 38, which bridge overlies cavity 36. A notched bridge nut 42 is also adhesively secured immediately adjacent one end of fingerboard 38 and remote from bridge 40.

A wood screw 44 is threaded into end 20 and holds one end of strings 46, 48 and 50. Strings 46, 48 and 50 are trained through the notches of bridge 40 and above fingerboard 38, through the notches of bridge nut 42, at which point they are engaged with shafts 52, 54 and 56 respectively of pegs 58, 60 and 62, which shafts extend through complemental transverse openings in peghead 38 and are in frictional engagement therewith in a well known manner.

The stringed instrument of the present invention may be quickly and economically made from standard pieces of lumber such as the 1 inch by 4 inch piece illustrated or with other sizes of wood, and it may be of regular shape as illustrated or may be shaped to an irregular contour. Furthermore, by virtue of the unique construction of the instrument, a high quality tone may be obtained with an instrument which is considerably smaller in size than conventional type instruments.

While there has herein been shown and described the presently preferred form of this invention, it is to be understood that such has been done for purposes of illustration only, and that, if desired, the instrument may be of larger or smaller size than illustrated, and of a variety of different shapes. Various other changes may be made therein within the scope of the appended claims.

What is claimed is:

1. A process for making a stringed musical instrument comprising the steps of:

(a) cutting a single standard piece of wood board having up and bottom surfaces to provide a body of predetermined length, (b) hollowing out the bottom surface of the body to form a cavity, leaving a thin top surface above the cavity, (c) reducing the width of one end of the body to form a peghead, (d) forming a plurality of transverse bores in the peghead, (e) positioning a fingerboard on the top surface of the body, extending longitudinally over the cavity, (f) mounting string supporting means on the top surface of the body adjacent the fingerboard, (g) placing a plurality of strings over the string supporting means, extending longitudinally of the fingerboard, (h) applying string tensioning means to the end of the body remote from the peghead, and (i) engaging the ends of the strings with the tensioning means and the pegs for holding the strings under tension.

2. The process of claim 1, wherein:

(a) the top surface above the cavity in the bottom surface is in the range of 1/16 inch to ½ inch.

3. The process of claim 2, wherein:

(a) the volume of the cavity is in the range of 9⅞ cubic inches to 10⅝ cubic inches.

4. A stringed musical instrument including:

(a) an elongated body of one-piece wood board construction, said body being of substantial thickness and having top and bottom surfaces, (b) the bottom surface of said body being hollowed out to provide a cavity extending a substantial portion of the body's length, leaving a thin top surface serving as a sounding board above the cavity, (c) one end of said body beyond the cavity being reduced in width to provide a peghead, (d) said peghead being provided with transverse bores, (e) pegs extending through the transverse bores of said peghead and in frictional engagement with the latter, (f) a fingerboard mounted longitudinally of the top surface of said body above the cavity, (g) bridge means mounted on the top surface of said body in alignment with said fingerboard and adjacent opposite ends thereof, (h) a plurality of strings extending longitudinally of said body above said fingerboard and supported by said bridge, and (i) means engaged with one end of said body for engagement by one end of said strings, (j) the opposite ends of said strings being engaged with said pegs for holding said string under tension.

5. The stringed musical instrument of claim 4, wherein:

(a) the thickness of the top surface of said body above the cavity is in the range of 1/16 inch to ½ inch.

6. The stringed musical instrument of claim 5, wherein:

(a) the volume of said cavity is in the range of 9⅞ cubic inches 10⅝ cubic inches.

7. The stringed musical instrument of claim 4, wherein:

(a) said body is constructed from a 1 inch by 4 inch board.

8. The stringed musical instrument of claim 4, wherein:

(a) said body is constructed from a 1 inch by 6 inch board.

9. The stringed musical instrument of claim 4, wherein:

(a) said body is constructed from a 1 inch by 8 inch board.

* * * * *